United States Patent [19]

DeLaura et al.

[11] 4,384,604

[45] May 24, 1983

[54] CHRISTMAS TREE DISPOSAL BAG

[76] Inventors: Andrew J. DeLaura, c/o George Spector, 3615 Woolworth Bldg., 233 Broadway; George Spector, 3615 Woolworth Bldg., 233 Broadway, both of New York, N.Y. 10007

[21] Appl. No.: 262,516

[22] Filed: May 11, 1981

[51] Int. Cl.[3] ..... B65D 30/10; B65D 85/00

[52] U.S. Cl. ..... 150/52 R

[58] Field of Search ..... 150/52 R; D6/105; D11/130

[56] References Cited

U.S. PATENT DOCUMENTS

| | | | |
|---|---|---|---|
| 1,446,416 | 2/1923 | Curtiss | 150/52 R X |
| 1,761,062 | 6/1930 | Werner et al. | D6/105 |
| 2,781,811 | 2/1957 | Dilar et al. | 150/52 R |
| 3,954,129 | 5/1976 | Rudell et al. | 150/52 R |

OTHER PUBLICATIONS

Sears Roebuck and Co., Christmas Book, 1937, p. 41.

*Primary Examiner*—William Price
*Assistant Examiner*—Sue A. Weaver

[57] ABSTRACT

A plastic bag in which a Christmas Tree may be disposed, so to prevent dry pine needles to fall therefrom, while being carried out, the bag including a small bottom opening through which the tree trunk extends downward to a tree stand, the bag in a collapsed position being draped over the tree stand so to hide it while the tree is being displayed during a Christmas season, and an interior apron around a top opening of the bag being made of fluffy cotton so to resemble a snow under the tree, portions of the cotton being impregnated with a stiffening material and compressed in molds so to form miniature houses which afterwards are colored so to resemble a village in a snowy landscape, the bag being pulled up around the tree when being discarded, and the top opening then being closed, to carry out the tree.

2 Claims, 5 Drawing Figures

11
15
3
24
24
19

19
22
17
20
18
16
10
21
12
13
14

3
18

11
10
14
15

11
10
18
15
14

15
24
24
20
19
23
10

CHRISTMAS TREE DISPOSAL BAG

This invention relates generally to Christmas Tree accessories.

It is well known that when a Christmas tree is disposed after the Christmas holidays, the pine needles thereof have by that time become dried, so that the needles readily drop off therefrom. This is particularly annoying as the tree is being carried out from the room because it leaves a trail of dropped needles throughout its travel within the home, and when trying to move it through doorways the wider lower branches are brushed against the doorway sides while squeezing through, so that a still greater amount of the needles are thus pulled off. This results in additional cleaning chores at such time, and the situation is accordingly in need of an improvement.

Therefore it is a principal object of the present invention, to provide a thin polyethylene plastic bag inside which the tree is fitted when being disposed, so that its dropping needles are not scattered upon a floor as the tree is carried outwardly from the home.

Another object is to provide a Christmas tree disposal bag which is fitted underneath the tree in a collapsed position while the tree is being displayed during the holidays, and which is thus in position for catching any falling needles meantime, and which afterwards need only to be pulled up around the tree so to completely enclose it prior to carrying out of the home.

Still another object is to provide a Christmas tree disposal bag which, when collapsed makes an attractive display underneath the tree during the Christmas holidays.

Figure 1:
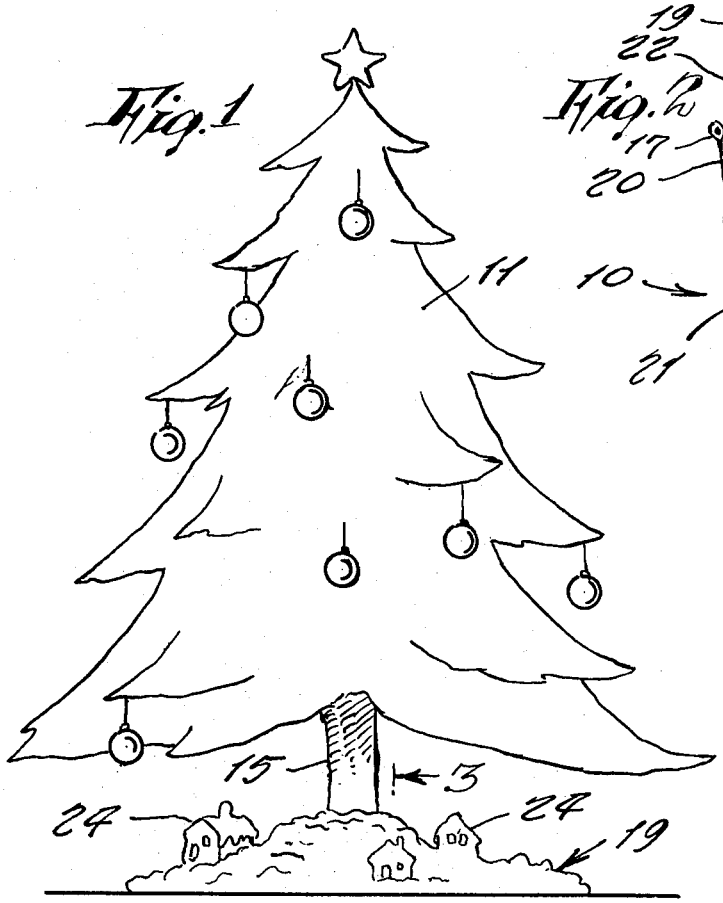
FIG. 1 is a side view of a displayed Christmas tree, and showing the present invention displayed therebeneath.
Figure 2:
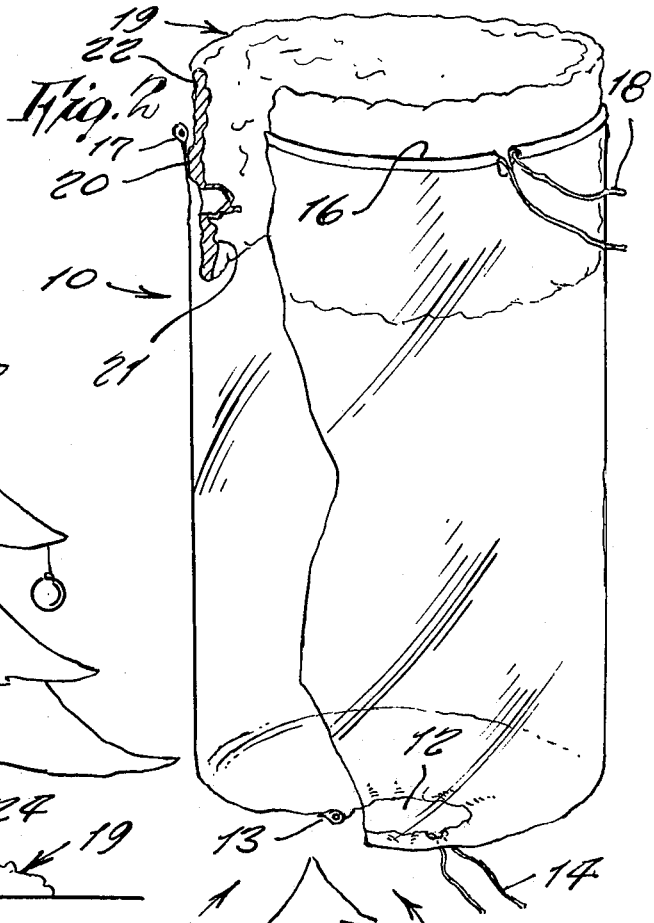
FIG. 2 is a perspective view of the bag invention, shown per se.
Figure 5:
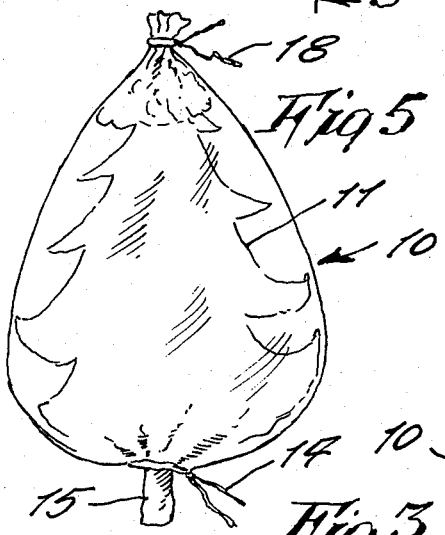
FIG. 5 is a side view showing the tree fully enclosed in the bag and ready for being carried out of a home for disposal.

Referring now to the drawing in greater detail, the reference numeral 10 represents a disposal bag for a Christmas tree 11, the bag being made of thin polyethene plastic such as is used for making conventional refuse and leaf disposal bags. It may be either clear or colored opaque. It is made in diameters so as to fit around the Christmas tree when its widest branches are bent inwardly, so as to fit through home doorways.

A small opening 12 at a lower end of the bag is rolled over so to form a peripheral groove 13 containing a draw string 14 in order to close the opening tightly around a tree trunk 15 inserted through the opening.

A large opening 16 around a top of the bag is a same diameter as the bag and includes groove 17 containing draw string 18.

A liner 19 of fluffy white cotton fits inside the opening 16 and is adhered thereto along a narrow band 20 thereof while the portion 21 of the liner extends freely into the bag and a portion 22 protrudes outwardly therefrom so to form a wide apron around the opening.

Figure 3:
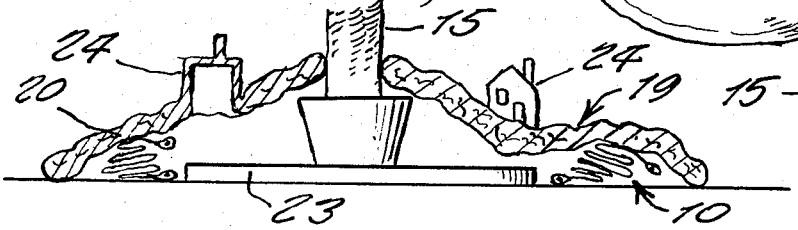
FIG. 3 is an enlarged cross sectional view taken on line 3—3 of FIG. 1, and showing the invention construction.

When setting up the tree for display upon a tree stand 23, the bag 10 is fitted in a collapsed condition around the tree trunk, with the trunk and stand extending through both openings 12 and 16, as shown in FIG. 3. The cotton liner is turned outwardly of the bag and packed snuggly around the tree trunk so to fully cover the bag and stand, and thus make a more pleasing appearance.

In order to further improve the appearance, portions of the liner cotton are satuarated with a hardening material such as liquidfied plastic which afterwards are then compressed in a mold so to form rigid designs of miniature houses 24 and which afterwards are either colored, or else the liquified plastic is already colored, so that the liner thus draped under the tree gives the appearance of a little village in a snowy landscape.

The liner may be spread a full width under the tree so to catch any falling pine needles, if so wished.

Figure 4:
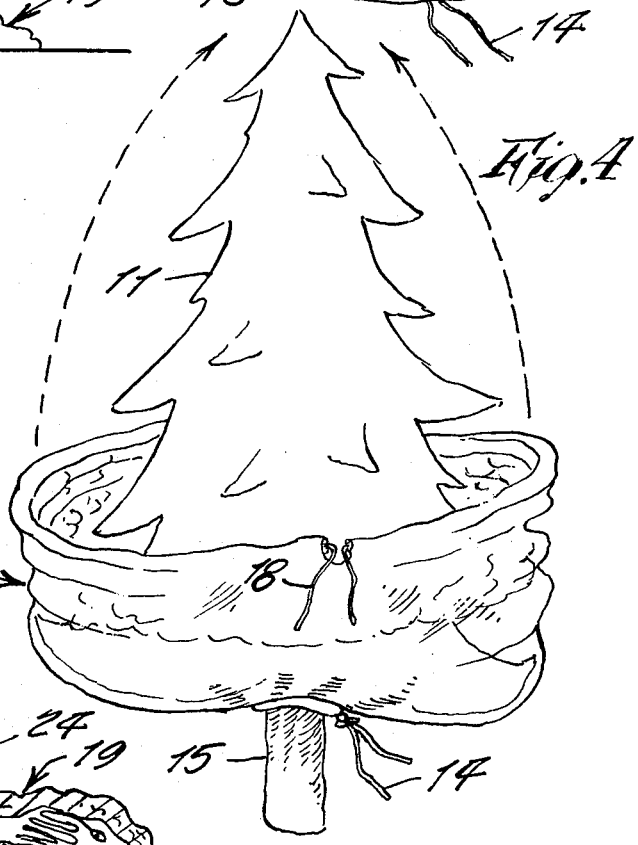
FIG. 4 is a perspective view showing the bag being pulled up around the side of the tree, so to bag it for disposal.

After the holiday season is ended, the liner is inverted back into the bag mouth as shown in FIG. 4, the draw string 14 is tied tightly around the tree trunk, and the bag is then pulled up all around the sides of the tree, and over the top, when the top opening is then closed by pulling the draw string 18. The tree may now be carried from the home without dropping pine needles.

While various changes may be made in the detail construction, it is understood that such changes will be within the spirit and scope of the present invention as is defined by the appended claims.

What is claimed is:

1. A Christmas tree disposal bag, comprising in combination, a bag of thin polyethylene plastic, with open top and bottom openings at opposite ends thereof, and a draw string around each said opening wherein a white cotton apron is adhered inside around said top opening, a portion of said apron extending inside said bag and a portion thereof protruding outwardly thereof, the first said portion having an adhesive band adhering to said bag, the first said portion extending inwardly beyond said band whereby when in collapsed position disposed about a christmas tree base the first said portion can extend radially inward beyond said collapsed bag to said tree base with the second said portion extending radially outward of said bag providing a protective decorative cover for said tree base.

2. A bag as in claim 1, wherein said apron is saturated with liquidfied plastic which can be molded by forms to provide decorative rigid designs.

* * * * *